US005899338A

United States Patent [19]

Fredriksson

[11] Patent Number: 5,899,338

[45] Date of Patent: May 4, 1999

[54] SCREENING APPARATUS FOR SEPARATING LIGHT IMPURITIES FROM PULP SUSPENSIONS

[75] Inventor: Börje Fredriksson, Sundsbruk, Sweden

[73] Assignee: Sunds Defibrator Industries AB, Sweden

[21] Appl. No.: 08/836,958

[22] PCT Filed: Nov. 13, 1995

[86] PCT No.: PCT/SE95/01340

§ 371 Date: May 22, 1997

§ 102(e) Date: May 22, 1997

[87] PCT Pub. No.: WO96/17998

PCT Pub. Date: Jun. 13, 1996

[30] Foreign Application Priority Data

Dec. 7, 1994 [SE] Sweden ..... 9404264

[51] Int. Cl.[6] ..... B03B 7/00

[52] U.S. Cl. ..... 209/17; 209/273; 209/306; 210/413

[58] Field of Search ..... 209/17, 270, 273, 209/274, 278, 281, 283, 305, 306; 210/413, 415

[56] References Cited

U.S. PATENT DOCUMENTS

| | | | |
|---|---|---|---|
| 4,107,033 | 8/1978 | Holz | 209/17 |
| 5,318,186 | 6/1994 | Rienecker | 209/273 |

FOREIGN PATENT DOCUMENTS

| | | | |
|---|---|---|---|
| 5-177172 | 7/1993 | Japan | 209/273 |
| 2 109 260 | 6/1983 | United Kingdom . | |

*Primary Examiner*—Tuan N. Nguyen
*Attorney, Agent, or Firm*—Lerner, David, Littenberg, Krumholz & Mentlik, LLP

[57] ABSTRACT

Apparatus for separating light impurities from a pulp suspension is disclosed. The apparatus includes a housing mounted on a fractionation device and symmetrically disposed with respect to the axis of rotation of the casing of the fractionation device, a passageway extending between the housing and the casing, and in which the top of the housing includes an outlet for the light impurities and a dilution liquid inlet for injecting dilution liquid tangentially into the housing.

7 Claims, 1 Drawing Sheet

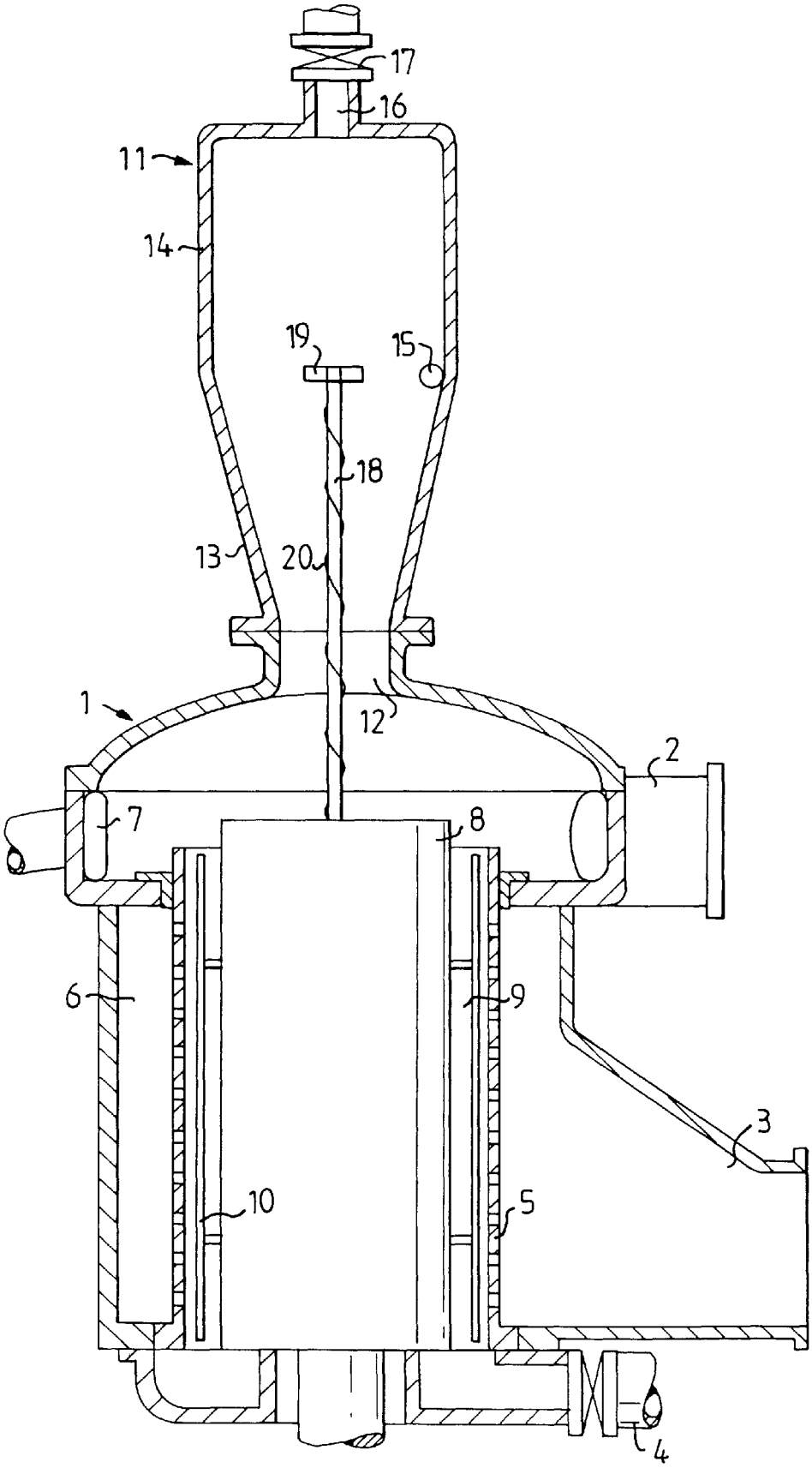
17
16
11
14
19
15
18
13
20
1
12
2
7
8
6
9
3
10
5
4

SCREENING APPARATUS FOR SEPARATING LIGHT IMPURITIES FROM PULP SUSPENSIONS

FIELD OF THE INVENTION

The present invention relates to an arrangement for separating light impurities from pulp suspensions in which light impurities are understood to be particles or aggregates with a lower density than water, such as plastic particles. Aggregates are found, for example, during flotation where a heavy particle is bound to a gas, and the aggregate particle/bubble behaves light a light particle.

BACKGROUND OF THE INVENTION

Heavy impurities in pulp suspensions are generally separated with conventional screens by means of centrifugal force in separate scrap taps, while coarse fiber fractions and impurities are generally separated by a screen member whereby the pulp is divided into accept and reject portions.

Light impurities are more difficult to separate, especially at high pulp concentrations. The pulp concentration, however, is desired to be high, for example, from about 3 to 5%, in order to achieve a high production capacity and to avoid the transport of large liquid volumes in the screening system.

Light impurities, therefore, are usually separated in separate devices, such as hydrocyclones. This requires not only separate equipment, but also low concentrations, below about 1%, in order to achieve a good result. It is, therefore, a less attractive method to vortex clean the entire flow from a pulp line. Instead, it is possible to carry out pressure screening through very fine slits at the highest possible concentration, and thereafter to use a vortex cleaner for separating the light impurities from the reject flow from the screens.

SUMMARY OF THE INVENTION

In accordance with the present invention a solution for the aforesaid problems has been provided, in that a device for removing light impurities is designed to be directly connected to the casing of a fractionation means, for example a conventional screen arrangement.

In accordance with the present invention, apparatus is provided for separating light impurities from a pulp suspension which is treated in a fractionation device having a casing with an upper portion for breaking up the fibrous network of the pulp suspension and for rotating the pulp suspension about an axis of rotation within the casing in order to enrich the light impurities therein, the apparatus comprising a housing having an upper portion and a lower portion symmetrically disposed with respect to the axis of rotation of the casing, and a passageway extending between the lower portion of the housing and the upper portion of the casing, the housing including an outlet for the light impurities located at the upper portion of the housing, and a dilution liquid inlet connected tangentially to the housing for injecting a dilution liquid into the housing.

In accordance with one embodiment of the apparatus of the present invention, the lower portion of the housing includes an upwardly diverging configuration and the upper portion of the housing includes a substantially cylindrical configuration.

In accordance with another embodiment of the apparatus of the present invention, the dilution liquid inlet is located between the upper and lower portions of the housing.

In accordance with another embodiment of the apparatus of the present invention, the housing includes an intermediate portion between the upper portion of the housing and a lower portion of the housing, the location of the intermediate portion of the housing being determined by the flow characteristics of the location of the dilution liquid inlet.

In accordance with another embodiment of the apparatus of the present invention, the apparatus includes a valve associated with the outlet for controlling the discharge of the light impurities therefrom.

In accordance with another embodiment of the apparatus of the present invention, the apparatus includes a rotor axle extending through the passageway into the housing, the rotor axle including a rotor element for effecting rotation of the contents within the housing. In a preferred embodiment, the rotor axle includes a screw thread for effecting upward feeding of the light impurities into the housing.

BRIEF DESCRIPTION OF THE FIGURE

The invention may be more fully appreciated with reference to the following detailed description, which, in turn, refers to the FIGURE, which is a side, elevational sectional view of the separation device of the present invention combined with a fractionation device in the form of a pulp screen.

DETAILED DESCRIPTION

Referring to the FIGURE, the apparatus shown therein comprises a pulp screen with an airtight casing 1, which has an inlet 2 for inject and outlets 3 and 4, respectively, for the accept portion and the reject portion, respectively. A symmetrical screening member 5 with a vertical axle is located in the casing 1. The pulp inlet 2, which is preferably tangential, communicates with the inside of the screening member 5 at the upper end thereof, while the reject outlet 4 communicates with the lower end of the screening member 5. The accept outlet 3 is connected to a space 6, which is located outside and extends about the screening member 5. In connection with the upper portion of the casing, a space with outlet 7 for heavy impurities, such as sand and scrap, is located.

A rotor 8 located within the screening member 5 extends along the entire screening member. The rotor 8 is concentric with the screening member 5 in such a way that a screening zone 9 is formed between the rotor and screening member and extends thereabout. The rotor 8 and screening member 4 can be cylindrical or conical.

The rotor 8 is preferably provided with wing elements 10, which are intended to bring about pulsations in the pulp in the screening zone 9 in order to break up the fiber network and to render it possible to divide the pulp into accept and reject portions.

A member 11 for the separation of light impurities is connected centrally to the upper portion of the casing 1 and communicates with the interior of the casing 1 through a passage 12. The member 11 is formed with a rotationally symmetrical housing, which preferably comprises a conically upwardly diverging lower portion 13 and a substantially cylindrical upper portion 14. In the transition between the lower and upper housing portions, 13 and 14, an inlet 15 for dilution liquid is connected tangentially, and an outlet 16 for light impurities is located centrally at the top of the housing 11. In the outlet 16 a valve 17 is located, for example a sluice valve, for controlling the outflow from the member 11.

A rotor axle 18 can be provided to extend from the casing 1 through the passage 12 upward into the housing portions, 13 and 14, and a rotor element 19 with a carrier is attached to the axle 18 in the housing portions, 13 and 14. The rotor axle 18 can be provided with a screw thread 20 for upward feeding. The rotor axle 18 is preferably driven by being attached to the rotor 8 of the fractionation device. The rotor element 19 is preferably located at the same height as the inlet 15 for dilution liquid so that correct flow geometry is obtained. The rotor element supplies energy, which otherwise must be supplied by the inlet rate and amount of dilution liquid. By using the rotor element, the amount of dilution liquid supplied can be reduced, while maintaining the effectiveness of the separation attained therein.

The pulp suspension is supplied through the inlet 2 in the casing 1 where it is caused to rotate due to the tangential supply and the rotation of the rotor 8. Scrap and other heavy impurities are collected in the space 7 due to the effects of centrifugal force. The pulp is introduced into the screening zone 9 and moves axially downward to the reject outlet 4 while being simultaneously rotated. The accept passes thereby through the apertures of the screening member 5. The wing elements 10 bring about pulsations in the pulp which facilitate the division into accept and reject portions. The reject is discharged through the outlet 4.

Due to the rotation of the pulp in the casing 1, the light impurities are collected centrally at the top of the casing. The location and design of the separation device 11 give rise to an upwardly directed flow centrally in the passage 12 at the same time as a downwardly directed return flow is caused in the outward portion of the passage 12.

In this manner, the light impurities are moved up through the passage 12 to the member 11, where they are collected centrally upwardly. By tangential supply of dilution liquid through the inlet 15 energy is supplied which drives the rotation and produces suitable flow conditions to enrich the impurities and promote the collection of light impurities centrally upwardly in the device 11. These impurities can thus be removed through the outlet 16. The discharge, which is controlled by a valve 17, can be continuous or intermittent, depending on the amount of impurities. When the arrangement comprises a rotor axle 18 with a rotor element 19, the rotation of the contents in the housing portions 13 and 14, is affected additionally, in that the effect of the tangential dilution liquid supply is increased.

The flow rate through the passage 12 shall be low, of the magnitude of about 0.02 m/s. The conical design of the lower portion 13 of the device 11 promotes circulation in this portion of the device, which is directed upwardly at the center and downwardly along the conical walls, at the same time as there is a horizontal rotational movement in the entire device 11. Owing to the location of the tangential inlet 15 for dilution liquid, an opposed circulatory movement is caused in the upper portion 14, i.e. a movement directed downwardly at the center and upwardly along the outer walls, which results in a movement of the light impurities toward the center in this portion 14.

In the embodiment shown in the Figure, the separation device 11 for light impurities is shown connected to a type of screen arrangement. It is obvious, however, that other types of fractionation means can also be applied, for example screens with rotating screen members and screens with other types of rotors. The screening can take place form the inside outwardly or from the outside inwardly through the screen member. The screening can also take place during the passage from above downwardly or from below upwardly through the screening zone. In all cases what is common is that the pulp suspension shall be rotated in the upper portion of the casing of the fractionation device.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for separating light impurities from a pulp suspension which is treated in a fractionation device having a casing with an upper portion for breaking up the fibrous network of said pulp suspension and for rotating said pulp suspension about an axis of rotation within said casing in order to enrich said light impurities therein, said apparatus comprising a housing having an upper portion and a lower portion symmetrically disposed with respect to said axis of rotation of said casing, and a passageway extending between the lower portion of said housing and the upper portion of said casing, said housing including an outlet for said light impurities located at said upper portion of said housing and a dilution liquid inlet connected tangentially to said housing for injecting a dilution liquid into said housing.

2. The apparatus of claim 1 wherein said lower portion of said housing includes an upwardly diverging configuration and said upper portion of said housing includes a substantially cylindrical configuration.

3. The apparatus of claim 1 wherein said dilution liquid inlet is located between said upper and lower portions of said housing.

4. The apparatus of claim 1 wherein said housing includes an intermediate portion between said upper portion of said housing and said lower portion of said housing, the location of said intermediate portion of said housing being determined by the flow characteristics of the location of said dilution liquid inlet.

5. The apparatus of claim 1 including a valve associated with said outlet for controlling the discharge of said light impurities therefrom.

6. The apparatus of claim 1 including a rotor axle extending through said passageway into said housing, said rotor axle including a rotor element for effecting rotation of the contents within said housing.

7. The apparatus of claim 6 wherein said rotor axle includes a screw thread for effecting upward feeding of said light impurities into said housing.

* * * * *